US005794509A

United States Patent [19]

DeLair et al.

[11] Patent Number: 5,794,509

[45] Date of Patent: Aug. 18, 1998

[54] PROPORTIONAL PNEUMATIC FIN ACTUATOR SYSTEM WITHOUT FEEDBACK CONTROL

[75] Inventors: Charles M. DeLair; Russell B. Cline, both of Tucson, Ariz.

[73] Assignee: Raytheon Company, Los Angeles, Calif.

[21] Appl. No.: 470,782

[22] Filed: Jun. 6, 1995

[51] Int. Cl.[6] ..... F15B 9/10

[52] U.S. Cl. ..... 91/376 R; 91/378; 91/380; 91/422; 92/98 D; 92/97

[58] Field of Search ..... 91/380, 376 R, 91/422, 378; 92/98 D, 97

[56] References Cited

U.S. PATENT DOCUMENTS

| | | | |
|---|---|---|---|
| 2,341,502 | 2/1944 | Ingres | 92/97 |
| 2,490,174 | 12/1949 | Teague | 91/380 |
| 2,496,369 | 2/1950 | Baghuis | 91/380 |
| 2,601,157 | 6/1952 | LeLan | 91/380 |
| 2,718,878 | 9/1955 | Du Bois | 92/97 |
| 2,980,067 | 4/1961 | Millard | 91/380 |
| 3,228,305 | 1/1966 | Wills | 91/378 |
| 3,554,086 | 1/1971 | Wills | 91/376 R |
| 4,803,415 | 2/1989 | Sepesy | 91/49 |

*Primary Examiner*—F. Daniel Lopez

*Attorney, Agent, or Firm*—David W. Collins; Leonard A. Alkov; Glenn H. Lenzen, Jr.

[57] ABSTRACT

An actuator system having a motor that drives a pneumatic spool valve to a known position based upon the number of step commands delivered to it. Valve ports or passages uncovered by the net position difference between the spool valve and a piston create gas flow to or from a control chamber. This gas flow causes a pressure differential across the face of the piston, inducing the piston to follow the spool valve. In this two-stage system, the piston acts as a force amplifier so that large forces and/or inertias may be actuated by positioning the motor. During steady state conditions, the piston achieves the same position as the spool valve is. Proportional control and very accurate positioning of the piston are provided without active position or position rate feedback control.

11 Claims, 4 Drawing Sheets

PROPORTIONAL PNEUMATIC FIN ACTUATOR SYSTEM WITHOUT FEEDBACK CONTROL

BACKGROUND

The present invention relates to actuation systems, and more particularly, to a proportional pneumatic missile fin actuator system that does not employ active feedback control.

With regard to proportional position control of a fin of a missile, conventional pneumatic actuator systems provide for modulation of control chamber pressure with an adaptation of single or dual on/off solenoid type valves, which are arranged to allow gas flow into and out of the chamber, or to prevent gas flow. This action is known as 3-way flow. More expensive spool valve implementations may also provide this 3-way action. Closed loop valve control is supplied by compensated fin position information, typically from a rotary or linear potentiometer. Classical or modem feedback control design techniques are used to define this compensation. This type of closed loop control requires valve response times much faster than the response time of the overall actuator. The limitations of valve response coupled with actuator variations over environmental extremes place a high demand for precise system performance tuning and may greatly reduce the reliability of the actuator. In fact, a recent flight demonstration program employed a typical pneumatic actuator system in which the performance was so marginal that actuator and flight failures were sustained on two occasions.

At a component level, the performance of conventional servo-type valves is a function of electromagnetic force elements that are integrated into the valve. These elements, including a coil, a magnetic path, and a moving armature, are basically components of a highly customized form of an electric servo motor. The servo motor is designed specifically for the particular valve application. This design can be complex, costly, and quite arduous to develop, depending upon the response goals for the valve. Because of the degree of customization and the limited application, the valve cost is almost always high. Furthermore, a servo amplifier required to operate the valve can also be quite complex. While this process may be necessary to fine tune valve performance for very restricted package geometry, development and production costs and schedules often demand a simpler method.

Also, typical proportional fin control systems almost always use a position feedback transducer of some sort, such as a rotary or linear potentiometer, an optical encoder, or a LVDT or RVDT, for example. These devices must be carefully specified due to their great sensitivity to the operational environment, and their procurement and precise installation requirements adds significantly to the cost of the system.

In view of the above, it is an objective of the present invention to provide for an improved proportional pneumatic actuator system that does not employ active feedback control, and that reduces the response and customization requirements.

SUMMARY OF THE INVENTION

In order to meet the above and other objectives, the present invention is a proportional pneumatic actuator system that does not employ active position or position rate feedback control. The actuator system comprises a housing that secures a stepper motor with an axial lead screw coupled to or integral with the rotational output shaft of the motor. A lead nut is coupled to the axial lead screw such that the lead nut translates along the axis of the lead screw as the lead screw rotates. A piston/cylinder assembly is disposed in the housing that comprises an outer cylinder body, an piston upper body, an outer piston sleeve and an piston inner body having an axial hole therethrough, and wherein the outer sleeve and inner body have passages therein for coupling operating gas therethrough. A spool valve is disposed in the axial hole through the piston assembly. An elongated axial quill is coupled between the lead nut and the spool valve.

A spool cavity plug is disposed in the end of the axial hole in the piston assembly opposite the axial quill. A piston clevis is attached to the piston assembly for moving an attached inertial mass. An upper diaphragm is captured by the piston upper body and piston inner body above the location of the spool valve, and a lower diaphragm is captured by the outer piston sleeve and the clevis below the location of the spool valve. The outer edges of the upper and lower diaphragms are captured by the outer cylinder body. The upper diaphragm, the piston assembly, and the central housing form a variable pressure control chamber therebetween. The diaphragms and the piston assembly form a constant pressure damping chamber therebetween. A gas supply is coupled through the housing for supplying operating gas to the damping chamber. One passage of the piston assembly is coupled to the damping chamber and the control chamber for supplying operating gas to the control chamber. Another passage of the piston assembly is coupled to the control chamber and an external vent for exhausting operating gas to the outside of the actuator system.

The prime feature of the actuator system is the motor that drives the pneumatic spool valve to a known position based upon the number of step commands delivered to it. Valve ports or passages uncovered by the net position difference between the spool valve and the piston assembly create gas flow to or from the control chamber above the upper diaphragm. This gas flow causes a pressure differential across the face of the piston, inducing the piston to follow the spool valve. In this two-stage system, the piston acts as a force amplifier so that large forces and/or inertias may be actuated by positioning the motor. During steady state conditions, the piston achieves the same position as the spool valve. Proportional control and very accurate positioning of the piston, and thus the fin, are provided without explicit knowledge of information that is required in a conventional proportional actuator system.

An embodiment of the proportional pneumatic fin actuator system has been tested and meets performance requirements in the presence of practical system uncertainties. Tests of the fin actuator system show it to have extremely reliable bandwidth, rate, stability, and accuracy characteristics. In the design and development of the present invention, actuator response variations as a function of temperature were effectively eliminated using frictionless rolling diaphragm seals for the piston, rather than conventional sliding seals. However, although the present invention benefits from the use of rolling diaphragm seals, this type of seal is not specifically required.

The present invention provides certain advantages, including the ability to achieve robust control of a proportional actuator system given the practical aspects of system design, in which the available package size, environmental extremes, and cost limitations preclude the use of a feedback device. The use of the spool valve has inherent advantages in terms of valve response and servo control authority. Using the stepper motor to drive the spool valve improves the consistency of valve performance under all conditions.

Also, from a control perspective, the use of the spool valve and moving sleeve presents a tremendous advantage. The typical servo control loop for a proportional hydraulic or pneumatic actuator commands the valve to open as a function of position error. Dynamic lags associated with the feedback device, the signal summing junction, the servo amplifier, and valve electrical and mechanical time constants all contribute to limited bandwidth and stability of the system. Valve time constants of about one order of magnitude faster than the overall actuator system are typically necessary in this implementation. For the present actuator, the pneumatic spool valve features mechanical feedback, such that the valve opening is exactly proportional to the error between the spool valve and the sleeve. The previously used dynamic elements are eliminated, and the resultant stability and control improvement is exceptional. Furthermore, the response demands of the valve are much closer to the desired system response, making the use of an off-the-shelf stepper motor feasible.

The actuator system is a low cost design that is compatible with fin control requirements such as those for an advanced TOW missile, an EFOG-M (NLOS) missile, and any other similar size missile system using proportional fin control. These requirements are characterized by low horsepower, high fin rate, and high bandwidth capabilities. Furthermore, the combination of control advantages provided by the stepper motor driven spool valve with mechanical feedback in conjunction with the advantages of a rolling diaphragm pneumatic actuator system may also provide a reliable, high performance pneumatic fin actuator system for vehicles in the AMRAAM class, which demand much higher fin control capability.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
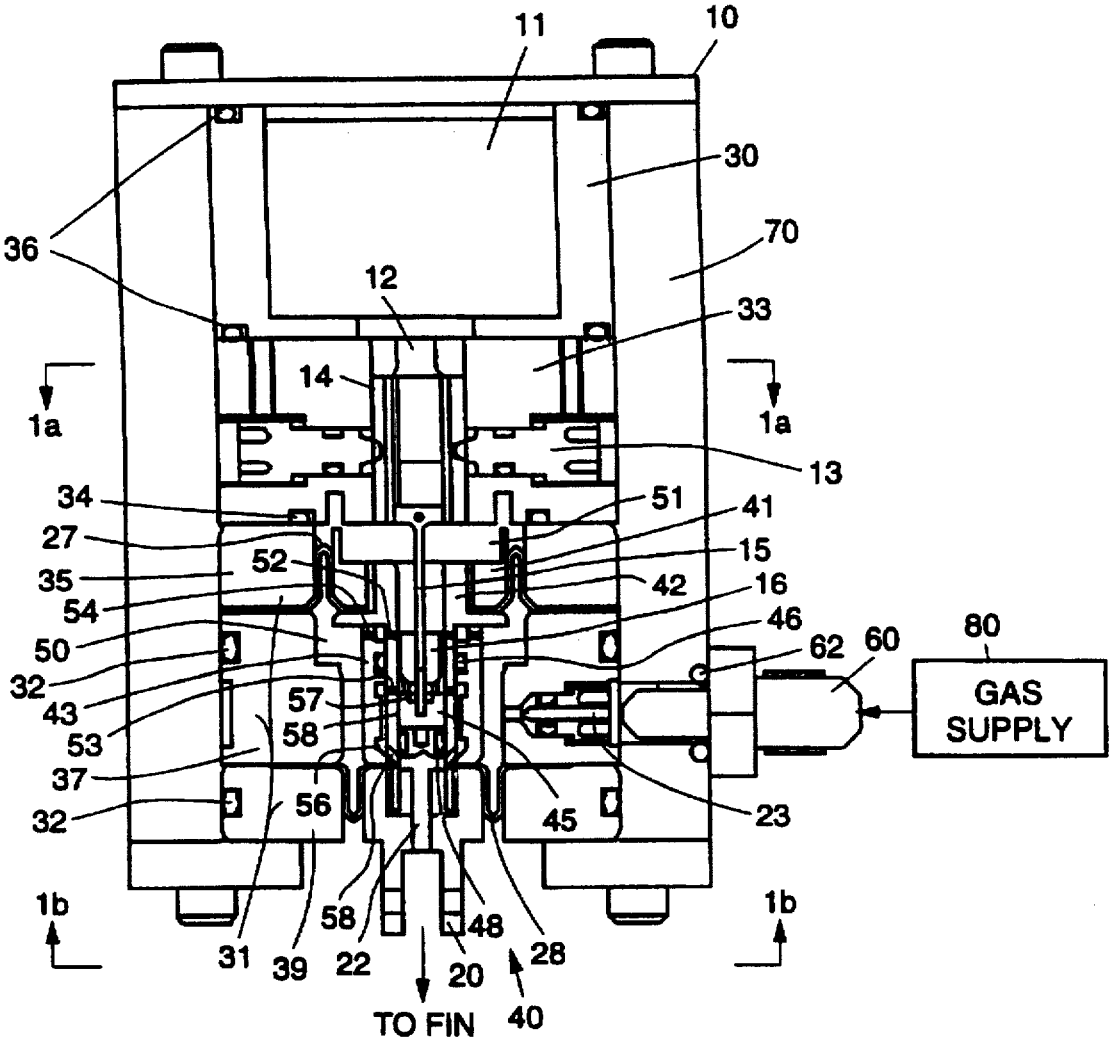
FIG. 1 illustrates a cross sectional side view of an embodiment of a proportional pneumatic missile fin actuator system in accordance with the principles of the present invention.
Figure 1A:
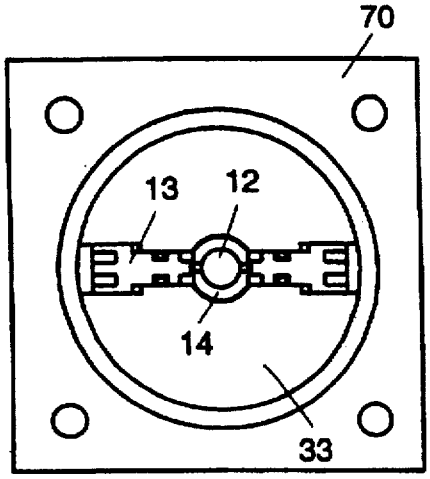
FIG. 1*a* illustrates a cross sectional top view of the proportional pneumatic missile fin actuator system of FIG. 1 taken along lines 1*a*—1*a*.
Figure 1B:
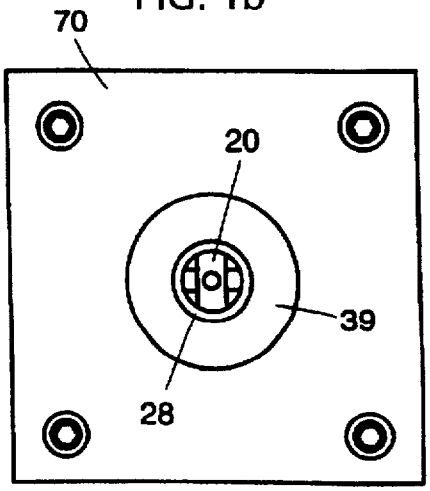
FIG. 1*b* illustrates a bottom view of the proportional pneumatic missile fin actuator system of FIG. 1 in the direction of lines 1*b*—1*b*.
Figure 2:
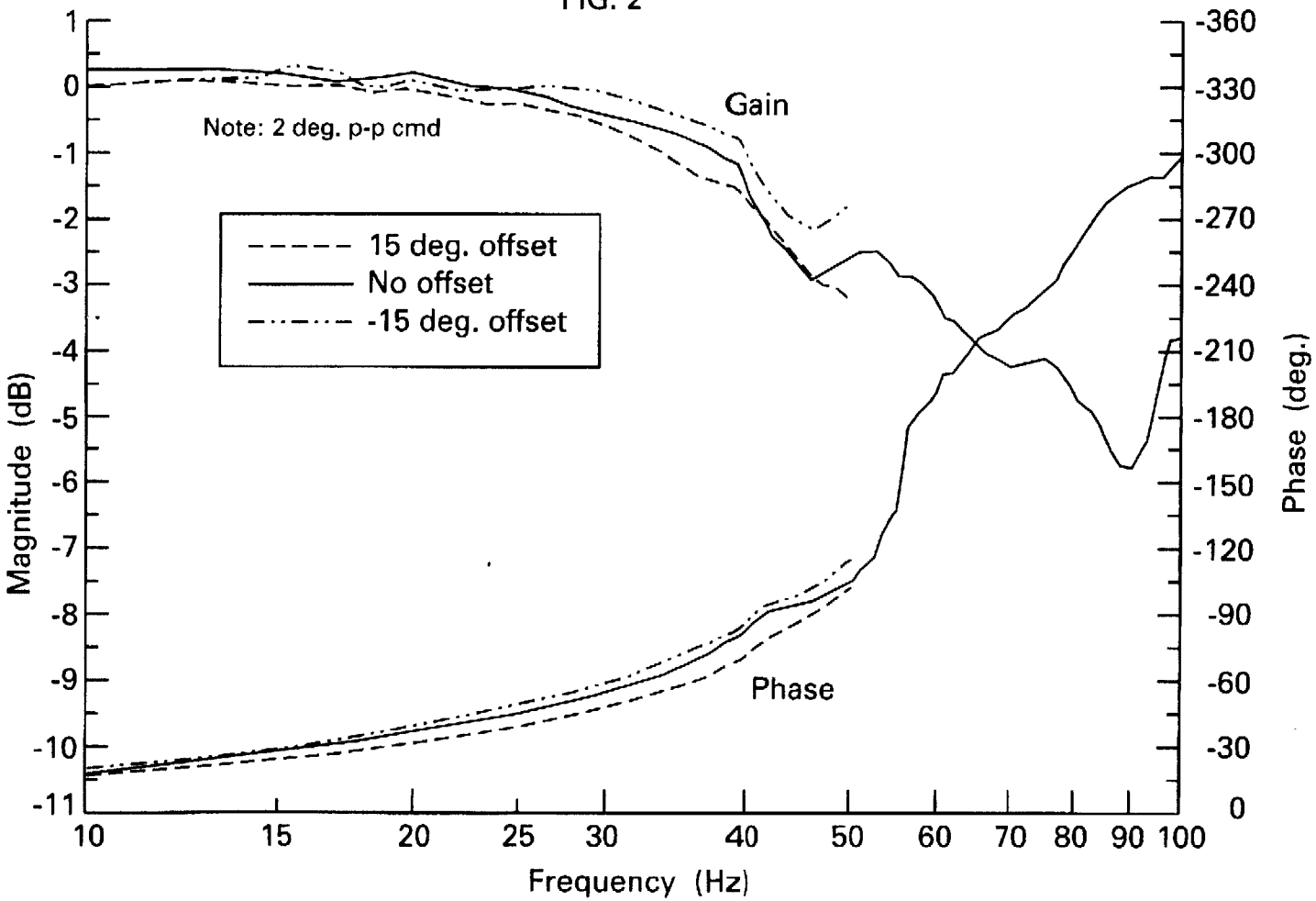
FIG. 2 is a plot of frequency response for the proportional pneumatic missile fin actuator system of FIG. 1.
Figure 3A:
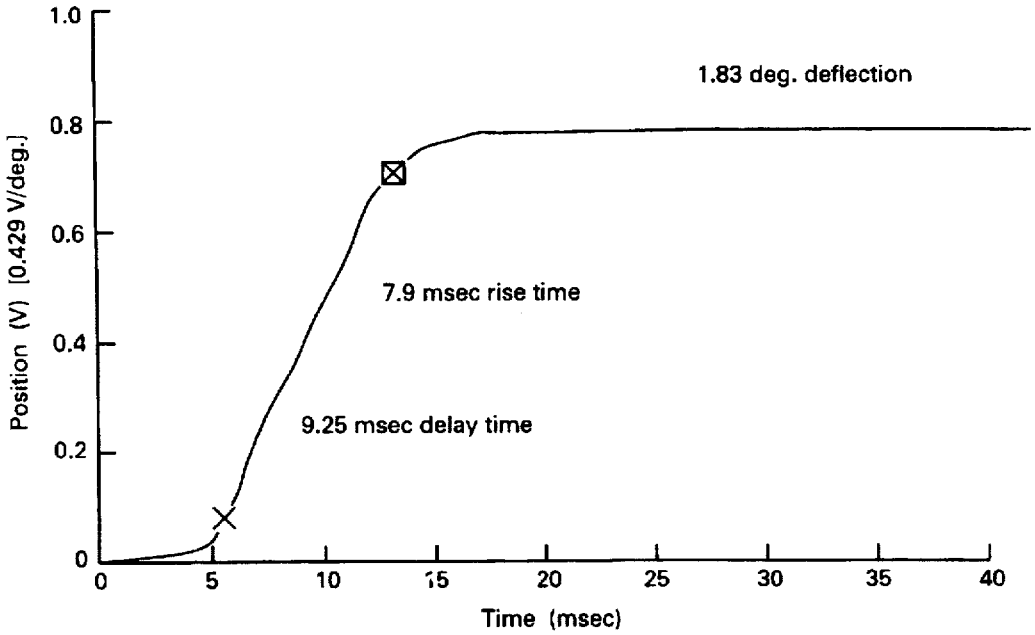
FIGS. 3*a* and 3*b* illustrate plots of step response for the proportional pneumatic missile fin actuator system of FIG. 1.
Figure 3B:
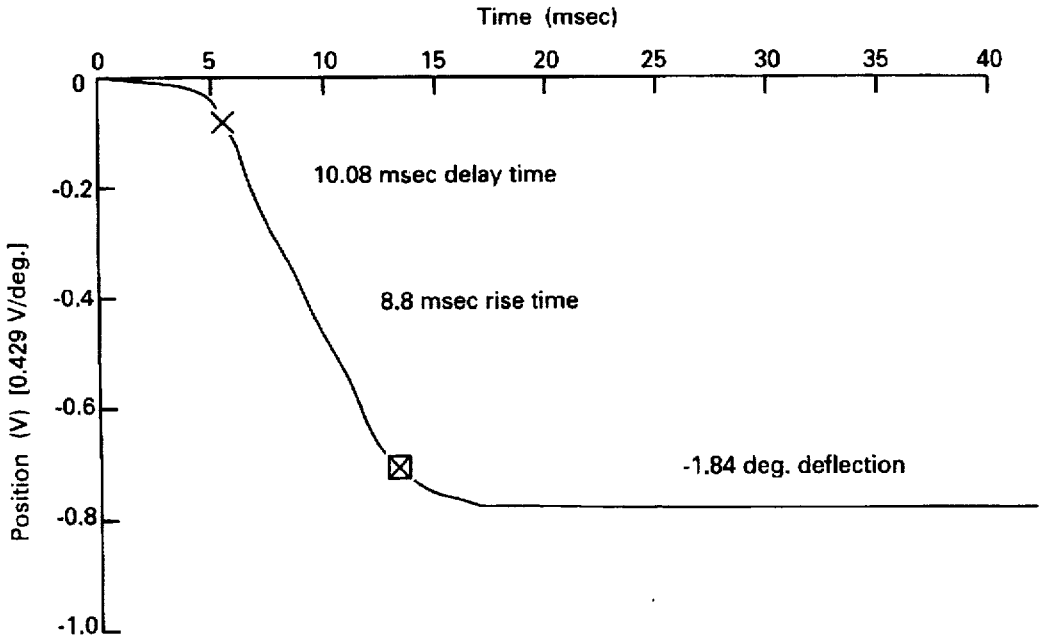
Figure 4A:
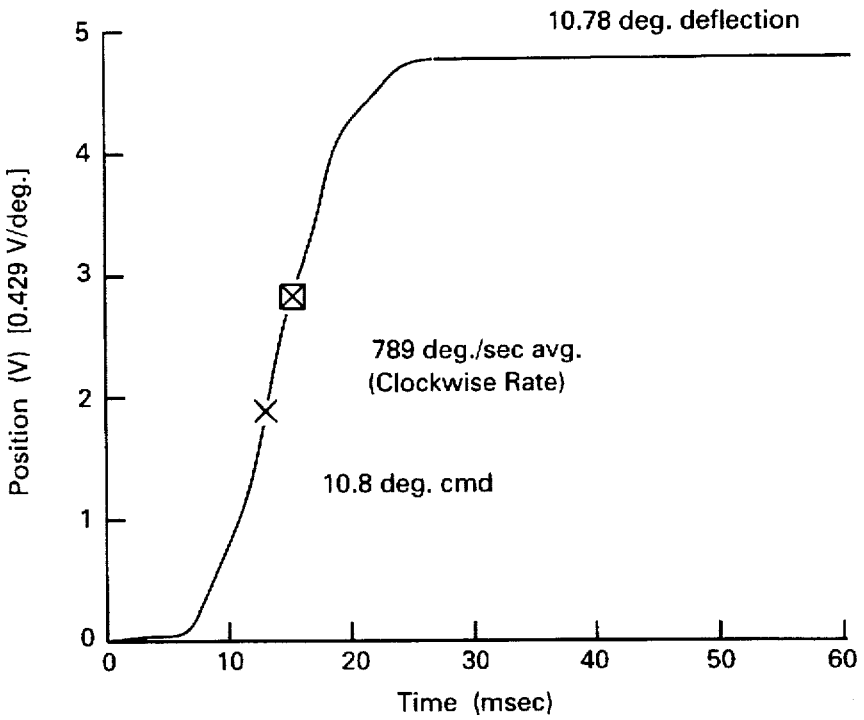
FIGS. 4*a* and 4*b* illustrate plots of slew rate for the proportional pneumatic missile fin actuator system of FIG. 1.
Figure 4B:
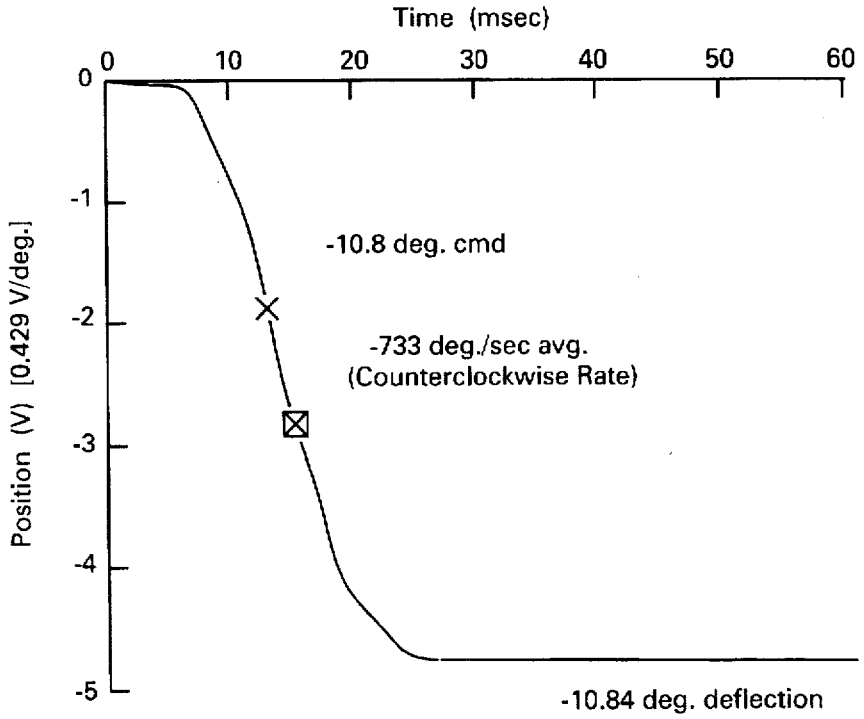

Referring to the drawing figures, FIG. 1 illustrates a cross sectional side view of an actuator system 10, or proportional pneumatic missile fin actuator system 10, in accordance with the principles of the present invention. FIG. 1*a* illustrates a cross sectional top view of the system 10 taken along lines 1*a*—1*a* of FIG. 1, while FIG. 1*b* illustrates a bottom view of the system 10 in the direction of lines 1*b*—1*b* of FIG. 1.

The proportional pneumatic fin actuator system 10 is comprised of major elements including a housing 70, a stepper motor 11, a piston assembly 40, and a spool valve 16. Structural stationary components of the actuator system 10 that provide gas passages, and sealing and mounting surfaces are a motor housing 30, a cylinder body 31, and a central housing 33. The cylinder body 31 is comprised of upper 35, mid 37, and lower 39 elements. Other embodiments of the system 10 may include the motor housing 30, the central housing 33, or portions of the cylinder body 31 made integral to the housing 70. The motor housing 30 is sealed to the central housing 33 and the housing 70 by means of O-ring seals 36. The cylinder body 31 is sealed to the housing 70 by means of O-ring seals 32. The central housing 33 is sealed to the upper cylinder body 35 by O-ring seal 34. An alternative arrangement may mount the motor 11 external to the housing 70.

The piston assembly 40 is comprised of a piston upper body 41, an inner body 42, an outer sleeve 43, a piston clevis 20, and a spool cavity plug 22. The inner body 42 and the outer sleeve 43 are sealed by an O-ring seal 46. The inner body 42 and the spool cavity plug 22 are sealed by an O-ring seal 48. The clevis 20 is securely attached to the piston assembly 40. The clevis 20 may linearly position an attached inertial mass, or it may rotate an inertial mass through a bellcrank (not shown).

A variable pressure control chamber 51 is created between an upper sealing member 27 comprising an upper rolling diaphragm 27 and the central housing 33. The upper rolling diaphragm 27 is captured and sealed on its inner diameter between the piston upper body 41 and the piston inner body 42, and on its outer diameter by the upper cylinder body 35 and the mid cylinder body 37. A lower sealing member 28 comprising a lower rolling diaphragm 28 is captured and sealed on its inner diameter by the outer piston sleeve 43 and the clevis 20, and on its outer diameter by the mid cylinder body 37 and the lower cylinder body 39. A constant pressure damping chamber 50 is created between the lower and upper rolling diaphragms 28, 27. Other embodiments of this actuator system 10 may use a sliding seal rather than the rolling diaphragms 27, 28, simplifying the piston assembly 40 and the cylinder body 31.

The action of the servo valve is created by coupling an output shaft of the motor 11 by way of a lead screw 12 and a lead nut 14 to an elongated axial quill 15. In a common mechanization, the lead screw 12 is integral to the output shaft of the motor 11. The lead nut 14 is prevented from rotating by two radially-oriented anti-backlash plugs 13, or other similar means, disposed in the central housing 33. The quill 15 connects to the spool valve 16. The spool valve 16 is disposed within an axial hole 17 through the inner body 42 of the piston assembly 40. The alternative arrangement that mounts the motor 11 external to the housing 70 seals the output shaft of the motor 11 to the motor housing 30 with a rotary shaft seal (not shown).

Gas is supplied to the actuator from a gas supply 80 through a supply pressure fitting 60, or port 60, which is coupled through the housing 70 and the mid cylinder body 37 with an orifice 23 that leads into the damping chamber 50. The fitting 60 is sealed to the housing 70 by means of an O-ring seal 62.

Fill passages 54 in the piston sleeve 43 couple gas in the damping chamber 50 to fill passages 52 in the piston inner body 42. Vent passages 53 in the piston inner body 42 exhaust to external low pressure atmosphere by way of passages 56 in the piston sleeve 43, and passages 58 in the piston inner body 42, that exit the piston assembly 40 below the spool cavity plug 22. The fill passages 52 and vent passages 53 in the piston inner body 42 are uncovered, and are thus coupled to the control chamber 51 by translation of the spool valve 16. The fill passages 52 are coupled directly to the control chamber 51. The vent passages 53 are coupled to a cavity 45 formed between the spool valve 16 and the piston assembly 40. The cavity 45 is coupled to the control chamber 51 by way of orifices 57 in the base of the spool valve 16.

Rotation of the output shaft of the motor 11 is communicated to the lead screw 12 which causes the lead nut 14 to translate along the axis of the lead screw 12. This moves the quill 15 which in turn moves the spool valve 16. The relative motion of the spool valve 16 and the inner body 42 of the piston assembly 40 uncovers an appropriate passage 52, 53 to allow operating gas to flow that restores the previous relationship between the spool valve 16 and the piston assembly 40.

In one mode of operation, operating gas enters the actuator system 10 at the supply pressure port 60 through the fitting 60 and passes through the orifice 23 into the damping chamber 50. The resulting pressure in the damping chamber 50 pushes the piston assembly 40 in a direction to increase the volume of damping chamber 50, which simultaneously decreases the volume of the control chamber 51. This causes a relative motion between the spool valve 16 (which does not move) and the piston assembly 40.

This motion is in such a direction as to allow gas flow from the damping chamber 50 through the fill passages 54 of the piston outer sleeve 43 and the fill passages 52 of the piston inner body 42, which communicate with the control chamber 51. This gas flow increases the pressure in the control chamber 51. The force associated with the pressure in the damping chamber 50 is the pressure in the damping chamber 50 times the difference in the effective areas of the upper and lower diaphragm 27, 28. The control force associated with the pressure in the control chamber 51 is the pressure in the control chamber 51 times the effective area of the upper diaphragm 27. When this control force is greater than the force from the damping chamber 50, such that the pressure in the control chamber 51 times area of the upper diaphragm 27 is greater than pressure in the damping chamber 50 times the difference in area of the upper diaphragm 27 and the area of the lower diaphragm 28, the motion of the piston assembly 40 is reversed.

Conversely, if the force exerted by the pressure in the control chamber 51 is greater than the force due to the constant pressure in the damping chamber 50, the piston assembly 40 is pushed in a direction to decrease the volume of damping chamber 50, which simultaneously increases the volume of the control chamber 51. This causes a relative motion between the spool valve 16 (which does not move) and the piston assembly 40 in such a direction as to allow gas flow from the control chamber 51 through the orifices 57 in the spool valve 16 into the cavity 45, then through the vent passages 53 of the piston inner body 42. The vent passages 53 communicate with low pressure atmosphere external to the actuator system 10 by way of passages 56 in the piston sleeve 43 and passages 58 in the piston inner body 42. This gas flow decreases the pressure in the control chamber 51, thus decreasing the associated control force from the control chamber 51. When this control force is less than the force from the damping chamber 50, such that the pressure in the control chamber 51 times area of the upper diaphragm 27 is less than pressure in the damping chamber 50 times the difference in area of the upper diaphragm 27 and the area of the lower diaphragm 28, the motion of the piston assembly 40 is reversed.

For ease of understanding, assume that the area of the upper diaphragm 27 is twice that of the lower diaphragm 28. Certain applications of the present invention, such as asymmetrical actuation of a missile fin, may appropriately utilize other ratios of areas, including the case in which the lower diaphragm 28 is larger than the upper diaphragm 27. In the present case, neglecting outside disturbances, a balance of forces is achieved when the pressure in the control chamber 51 is one half that of the damping chamber 50. When the pressure in the control chamber 51 is different than that desired pressure, the piston assembly 40 moves in such a manner to uncover the correct passage in the inner body 42 to correct that pressure.

For instance, when the pressure in the control chamber 51 is more than one half that of the damping chamber 50, the piston assembly 40 moves in a direction that increases the volume of the control chamber 51, which uncovers the vent passage 53 in the piston inner body 42 by the relative motion between the inner body 42 and the spool valve 16. The vent passages 53 allows gas to vent from the control chamber 51 by way of the orifices 57 in the spool valve 16 through the vent passages 56 in the piston sleeve 43, vent passages 58 in the piston inner body 42, and the clevis 20 to the exterior of the actuator system 10, lowering the pressure in the control chamber 51.

Similarly, if the pressure in the control chamber 51 is less than one half that of the damping chamber 50, the piston assembly 40 moves in a direction that decreases the volume of the control chamber 51, which uncovers passage 52 in the piston inner body 42 by the relative motion between the inner body 42 and the spool valve 16. The fill passages 52 allow gas to flow from the damping chamber 50 through the fill passages 54 in the piston sleeve 43, and the fill passages 52 in the piston inner body 42 to the control chamber 51, raising the pressure in the control chamber 51.

In general, the orifice 23, which acts as the passage from the supply pressure port 60 to the damping chamber 50, provides a passive damping force by effectively isolating the damping chamber 50 from the gas supply 80 at higher rates and frequencies of relative motion of the piston assembly 40.

Thus, it is seen that the action of the relative motion of the piston assembly 40 and the spool valve 16 causes the pressures in the chambers 50, 51 to come to values that result in an equilibrium of forces on the piston assembly 40, and the maintenance of a fixed steady state position of the piston assembly 40.

Similarly, and very importantly, it can be seen that an external force, such as an aerodynamic load caused by the deflection of a missile control fin, applied to the clevis 20 (within system design limits imposed by the areas and pressures) results in a motion of the piston assembly 40, and consequently an appropriate flow of pressurized gas into or out of the control chamber 51. This results in an equilibrium of forces on the piston assembly 40 and a restoration of the position of the piston assembly 40 to its location prior to the application of the force.

Active control of the actuator position is achieved by changing the position of the spool valve 16. Rotation of the output shaft of the motor 11 is communicated to the lead screw 12 which causes the lead nut 14 to translate along the axis of the lead screw 12. Rotation of the lead nut 14 is prevented by the two anti-backlash plugs 13. This moves the quill 15 which in turn moves the spool valve 16. The relative motion of the spool valve 16 and the piston inner body 42 results in the appropriate passage 52, 53 being uncovered to allow operating gas to flow to move the piston assembly 40 to the new position of the spool valve 16 and restore the previous relative position relationship between the spool valve 16 and the piston assembly 40.

The salient feature of the stepper motor 11 that is most significant to the system 10 is that within the design bounds of the motor 11, its rotary shaft position can be predicted to a great degree of accuracy by counting the number of step commands delivered to it. The output shaft of the motor 11 rotates through a fixed and known angle for each step command that it receives. The corresponding rotation of the lead screw 12 is the same as the shaft of the motor 11. The translation of the lead nut 14 is governed by the mechanical lead established by the thread pitch of the lead screw 12, which can be specified to extreme accuracy. Therefore, the position of the lead nut 14 can be reliably determined without measurement based on the number of step commands delivered to the motor 11.

The lead nut 14 is attached to the spool valve 16 through the quill 15 which is very stiff along the axis of motion. Thus, the relative position of the lead nut 14 and the spool valve 16 remains constant and the absolute position of the spool valve 16 is determined by the absolute position of the lead nut 14, which is known by the number of commands delivered to the motor 11. It follows that the position of the spool valve 16 can be determined very accurately without measuring this position with an active measurement device. The actuation forces necessary to rotate the shaft of the motor 11, and therefore, to position the spool valve, are quite small due to the extremely low mass of the moving components, resulting in input power demands that are quite low.

Finally, as previously described, the piston assembly 40 follows the motion of the spool valve 16, which is controlled by the motor 11 by way of the lead screw 12 and lead nut 14. Thus, the clevis 20, which is securely attached to the piston inner body 42, may therefore be positioned with great accuracy to any desired position by rotating the shaft of the motor 11 through an appropriate number of steps. The system 10 acts as a force amplifier by using low input power to the motor 11 so position the spool valve 16, generating gas flow relative to the control chamber 51, and creating force differentials across the face of the piston assembly 40 that greatly exceed the input force necessary to rotate the shaft of the motor 11;

The clevis 20 linearly positions an attached inertial mass, or rotates an inertial mass, such as a missile fin, by way of a bellcrank, for example. Rotary motion may also be provided by operating two actuator systems 10 in parallel and coupling their respective devises 20 through a common crank mechanism. In any of these embodiments of the present invention, if the position of the clevis 20 is known at any time (such as when the actuator system 10 is started) its position may then be calculated at any later time by keeping an account of the number and direction of all steps taken by the motor 11 after that time. The precise positioning of the clevis 20 may be achieved without active monitoring of the position of elements in the actuator system 10, including the motor 11, the lead nut 14, the spool valve 16, or the piston assembly 40.

In summary, the motor 11 thus drives the pneumatic spool valve 16 to a known position based upon the number of step commands applied to the motor 11. Valve ports (fill passages 52, 53) uncovered by the net position difference between the spool valve 16 and the piston assembly 40 create gas flow to or from the control chamber 51 above the upper diaphragm 27. This gas flow causes a pressure differential across the face of the piston assembly 40, inducing it to follow the spool valve 16. In this two stage system, the piston assembly 40 acts as a force amplifier such that large forces and/or inertias may be actuated by positioning the motor 11. During steady state conditions, the piston assembly 40 achieves the same position as the spool valve 16. Proportional control and very accurate positioning of the piston assembly 40, and thus a fin, for example, are provided without explicit knowledge of information that is required in a conventional proportional actuator system.

The performance of the actuator system 10 was tested. Tests were conducted at laboratory ambient temperature and extreme temperature conditions. All measured performance parameters, including bandwidth, step response, slew rate, response symmetry, and position accuracy are beyond the specified design requirements of the system 10. Plots of the system frequency response, step response, and slew rate are shown in FIGS. 2, 3*a* and 3*b*, and 4*a* and 4*b* respectively. Of significant note is the demonstration of robust stability of the effectively open loop pneumatic piston assembly 40, which has the highest performance risk. A step command to any servo system is the most likely realistic input that would incite instability, but as depicted in the figures, there is absolutely no evidence of an inadequate stability margin. This performance verifies the robust operation of the present actuator system 10.

As another figure of merit for robustness, the actuator system 10 was able to deliver reliable, repeatable performance even after many temperature cycles and several hours of testing. The mechanical design, especially that of the spool valve 16, is quite rugged. The predictions of a rigorous numerical simulation closely match the actual test results. A functionally robust pneumatic missile fin actuator system 10 without feedback control was thus verified.

Thus there has been described a new and improved proportional pneumatic actuator system that does not employ active feedback control. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. An actuator system comprising:

a housing;

a motor housing secured to the housing;

a central housing secured to the housing;

a cylinder body secured to the housing comprised of an upper cylinder body, a mid cylinder body, and a lower cylinder body;

a stepper motor disposed in the motor housing coupled to a moveable axial lead screw and lead nut;

a piston assembly disposed in the housing comprising a piston upper body, a piston inner body having an axial hole therethrough, and a piston outer sleeve, wherein the inner body has passages therein for coupling operating gas therethrough, and wherein the outer sleeve has passages therein for coupling operating gas therethrough;

a spool valve having orifices therein disposed in the axial hole through the piston assembly, wherein a cavity is formed between the spool valve and the piston assembly, and wherein the passages of the piston assembly are coupled to the cavity;

an elongated axial quill coupled between the lead nut and the spool valve;

a spool cavity plug disposed in an end of the axial hole in the piston assembly;

a piston clevis attached to the piston assembly for moving an attached inertial mass;

an upper sealing member disposed above the location of the spool valve captured and sealed on its inner diameter between the piston upper body and the piston inner body, and on its outer diameter by the upper cylinder body and the mid cylinder body;

a lower sealing member disposed below the location of the spool valve captured and sealed on its inner diameter by the outer piston sleeve and the clevis, and on its outer diameter by the mid cylinder body and the lower cylinder body;

a variable pressure control chamber formed between the upper sealing member, the piston assembly, and the central housing;

a constant pressure damping chamber formed between the lower sealing member, the upper sealing member, and the piston assembly; and gas supply means coupled to the housing for supplying operating gas to the system by way of the damping chamber.

2. The system of claim 1 which further comprises a plurality of radially-oriented anti-backlash plugs disposed in the central housing that prevent the axial lead nut from rotating.

3. The system of claim 1 wherein the motor housing is sealed to the housing and the central housing by means of O-ring seals, the cylinder body is sealed to the housing by means of O-ring seals and to the central housing by means of O-ring seal, and the piston outer sleeve and piston inner body of the piston assembly are sealed by means of O-ring seals.

4. The system of claim 1 wherein the motor disposed within the motor housing is secured external to the housing.

5. The system of claim 1 wherein the lead screw is integral to an output shaft of the motor.

6. The system of claim 1 wherein the motor housing is integral to the housing.

7. The system of claim 1 wherein the central is integral to the housing.

8. The system of claim 1 wherein the cylinder body is integral to the housing.

9. The system of claim 1 wherein the sealing members comprise rolling diaphragms.

10. An actuator system comprising:

a housing;

a stepper motor coupled to the housing and having a rotatable output shaft that is coupled to an axial lead screw;

a lead nut coupled to the axial lead screw such that the lead nut translates along an axis of the lead screw in response to rotation thereof;

a piston assembly disposed in the housing having an axial hole therethrough, and having passages therein for coupling operating gas therethrough, and wherein the piston assembly comprises a piston upper body, a piston inner body having the axial hole therethrough, and a piston outer sleeve, wherein the inner body has a first predetermined set of fill and vent passages therein, and wherein the outer sleeve has a second predetermined set of fill and vent passages therein;

a spool valve disposed in the axial hole through the piston assembly;

a piston clevis attached to the piston assembly for moving an inertial mass attached thereto;

an upper sealing member disposed between the piston upper body and piston inner body above the spool valve;

a lower sealing member disposed between the outer piston sleeve and the clevis below the spool valve;

an elongated axial quill coupled between the lead nut and the spool valve;

a variable pressure control chamber formed in the housing;

a constant pressure damping chamber formed in the housing;

gas supply means coupled to the housing for supplying operating gas to the damping chamber;

fill passages selectively coupled between the damping chamber and the control chamber for supplying operating gas to the control chamber; and vent passages selectively coupled to the control chamber for exhausting operating gas outside the actuator system;

and wherein the stepper motor is caused to drive the pneumatic spool valve to a known position based upon the number of step commandos supplied thereto, and wherein the vent and fill passages are selectively uncovered in response to movement of the spool valve and the piston assembly which creates gas flow to or from the control chamber and causes a pressure differential across the face of the piston, thus inducing the piston to follow the spool valve and provide proportional control and accurate positioning of the piston without feedback control.

11. The system of claim 10 wherein the sealing members comprise rolling diaphragms.

* * * * *